United States Patent [19]

Smyrloglou

[11] Patent Number: 4,978,371

[45] Date of Patent: Dec. 18, 1990

[54] FILTERED STATIC ELIMINATING BLOW-OFF GUN

[76] Inventor: Eli Smyrloglou, 4 Kidder Rd., Chelmsford, Mass. 01824

[21] Appl. No.: 412,472

[22] Filed: Sep. 26, 1989

[51] Int. Cl.[5] ..... B03C 3/38

[52] U.S. Cl. ..... 55/102; 55/124; 361/229; 361/234

[58] Field of Search ..... 55/102, 124, 360; 361/229, 234

[56] References Cited

U.S. PATENT DOCUMENTS

| | | | |
|---|---|---|---|
| 4,060,874 | 12/1977 | Furutsutsumi | 15/405 |
| 4,243,178 | 1/1981 | Self | 239/436 |
| 4,308,654 | 1/1982 | Bogart | 55/16 |
| 4,364,147 | 12/1982 | Biedermann et al. | 15/404 |
| 4,514,780 | 4/1985 | Brussee et al. | 361/226 |
| 4,541,141 | 9/1985 | Le Goff | 15/302 |
| 4,670,341 | 6/1987 | Lundsager | 428/372 |
| 4,677,704 | 7/1987 | Huggins | 15/1.5 R |
| 4,691,536 | 9/1987 | Yorisue et al. | 66/168 |
| 4,695,382 | 9/1987 | Cronin | 210/436 |
| 4,711,717 | 12/1987 | Wolf | 210/137 |
| 4,744,906 | 5/1988 | Gerlach et al. | 210/651 |

OTHER PUBLICATIONS

Black Jack TM "Nitrogen Blow-Off Gun System with Static Elimination", Advertising Brochure, Omega Specialty Instrument Co., Chelmsford, MA., Copyright 1988.

*Primary Examiner*—Bernard Nozick

*Attorney, Agent, or Firm*—Foley & Lardner, Schwartz, Jeffery, Schwaab, Mack, Blumenthal & Evans

[57] ABSTRACT

A blow-off gun is provided having a static eliminator having a gas inlet end and a gas outlet end. A removable hollow fiber filter is retained in and extends into the gas inlet end of the static eliminator. The hollow fiber filter communicates with a supply of gas through a handle portion of the gun. Located within the handle portion is a valve and trigger assembly, the valve being provided with a pin hole to supply a constant positive flow of gas, thereby to prevent backflow of ambient air into the gun.

10 Claims, 2 Drawing Sheets

FILTERED STATIC ELIMINATING BLOW-OFF GUN

BACKGROUND OF THE INVENTION

1. Field of the Invention

The present invention relates to a combination ultrafilter/static eliminator adapted for use in a gas blow-off gun for clean room applications.

2. Discussion of the Related Art

Currently, many different types of clean room particle removal devices are commercially available. One type that has proven particularly successful is the so-called gas blow-off gun, such as the "Black Jack", commercially available from Omega Specialty Instrument Co., Chelmsford, MA. These guns include a handle portion connected to a source of gas. A trigger and valve assembly is disposed in the handle portion to control the release of gas into the remainder of the gun. From the handle portion, the gas flows into a cellulose filter cartridge which is surrounded by an outer nozzle housing. A gold-polonium -210 static eliminator is connected to an outlet end of the filter cartridge. Using this arrangement, the blow-off gun provides a particle free deionizing gas stream for clean room applications. While these blow-off guns are simple in construction and have proven commercially successful, they suffer from a number of practical difficulties. Although the cellulose cartridge has proven adequate for most filtering needs, it cannot typically remove particles as small as 0.02 μm. Furthermore, in the prior blow-off gun system, ambient air would sometimes backflow into the static eliminator portion of the gun, thereby producing ozone, which damages the assembly. Finally, the serial cartridge/static eliminator arrangement of the prior gun results in a longer gun which is somewhat awkward for some users to operate.

SUMMARY OF THE INVENTION

Accordingly, it is an object of the present invention to provide a combination filter/static eliminator cartridge that can remove very small particles.

A further object of the present invention is to provide a blow-off gun having a more compact design.

A further object of the present invention is to provide a blow-off gun wherein backflow of air into the interior of the gun is prevented.

The foregoing and further objects are attained by providing a blow-off gun comprising a static eliminator having a gas inlet end and a gas outlet end. A removable compact hollow fiber filter is retained in and extends into the gas inlet end of the static eliminator. The hollow fiber filter communicates with a supply of inert gas through a handle portion of the gun. Located within the handle portion is a valve and trigger assembly, the valve being provided, in a preferred embodiment, with a pin hole to supply a constant positive flow of gas, thereby to prevent backflow of ambient air into the gun.

Further objects and advantages of the present invention will become readily apparent from the specification and drawings which follow.

DETAILED DESCRIPTION OF THE PREFERRED EMBODIMENTS

Figure 1:
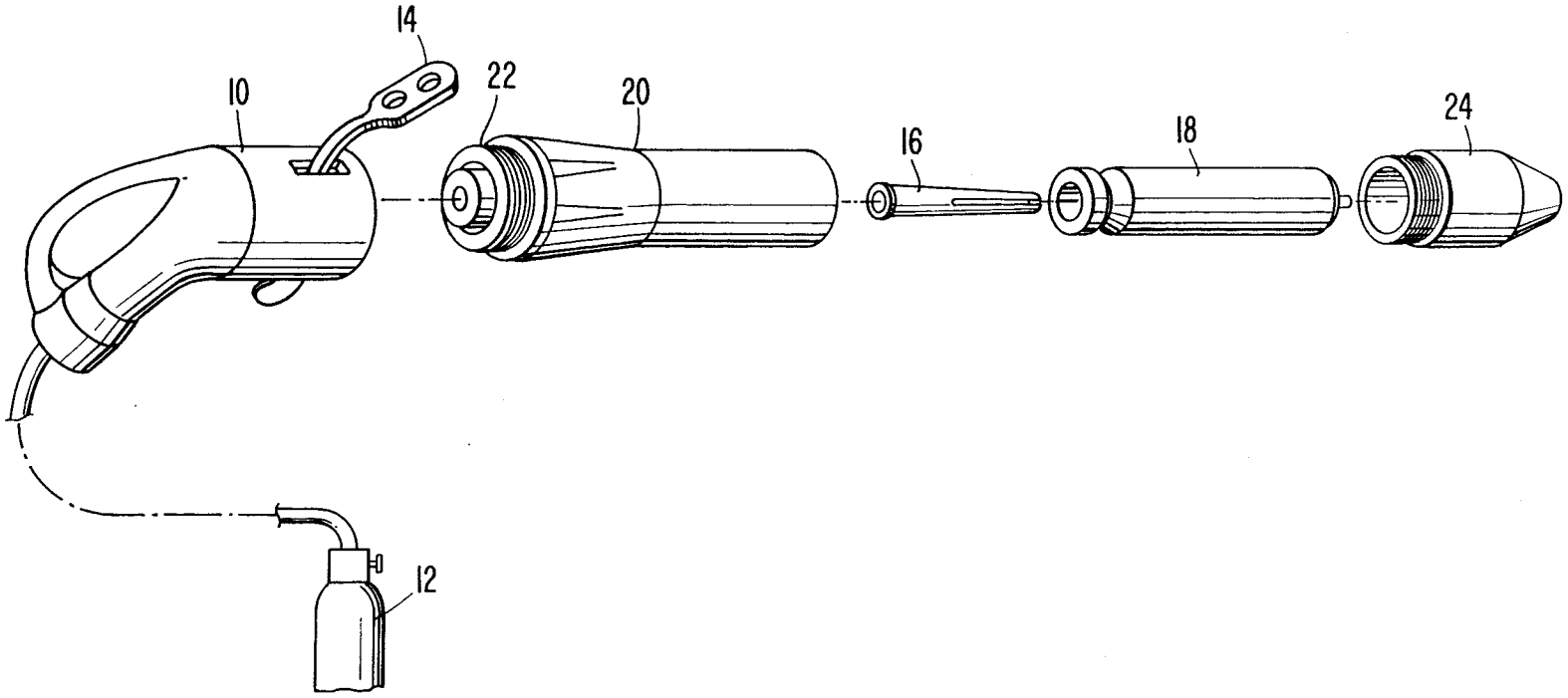
FIG. 1 is an exploded perspective view of a blow-off gun according to the present invention.

As shown in FIG. 1, the present invention contemplates a blow-off gun for clean room application comprising a handle portion 10 which is connected to a source 12 of gas, such as air, nitrogen, carbon dioxide or the like. The gas is controllably supplied to the remainder of the gun via a trigger mechanism 14 located at an outlet end of the handle portion 10. The gas supply is advantageously provided at a controlled pressure by means of an adjustable tank valve.

The gas flows into a removable hollow fiber filter 16 which is retained in and, in the preferred embodiment shown, has a major portion extending into a static eliminator 18. The removable hollow fiber filter 16 and static eliminator 18 are housed in a cylindrical housing 20 having a threaded portion 22 for connection with the handle portion 10.

The gas passes through the hollow fiber filter 16 which is capable of removing particles as small as 0.02 μm in gas streams. Such hollow fiber filters have well known applications in medical fields, especially filtering blood for dialysis, as shown in U.S. Pat. No. 4,670,341.

The gas flows out of the hollow fiber filter 16 into the static eliminator 18. The static eliminator is preferably a nuclear gas ionizer similar to that known by the trade name Nuclecel TM, manufactured by NRD, Inc., Grand Island, NY. Nuclear gas ionizers produce both positive and negative ions in constant balance. Thus, a charge is imparted to the gas streaming through the device. This charged gas will then remove the static charges from any surface on which it impinges. Typically, up to 4,000 volts can be reduced to zero in a matter of seconds on a typical 4 inch silicon wafer.

The Nuclecel TM nuclear static eliminator contains polonium-210 locked in a solid precious metal foil, such as gold. The polonium-210 decays to omit alpha particles consisting of positively charged helium nuclei. Such alpha particles travel fewer than 2 inches in gases and are incapable of penetrating an ordinary sheet of paper. The positively charged alpha particles strip electrons from the gas streaming from the device thereby creating free positive and negative ions.

The ionizing gas stream then exits the static eliminator 18 and flows through nozzle 24 to impinge upon a surface to be cleaned. Since electrostatic charge attracts ions of opposite charge, if the surface is positively charged, it will attract negative ions, while if it is negatively charged it will, of course, attract positive ions. Thus, the ions will interact with the charge, exchanging electrons to create a neutral state.

Figure 2:
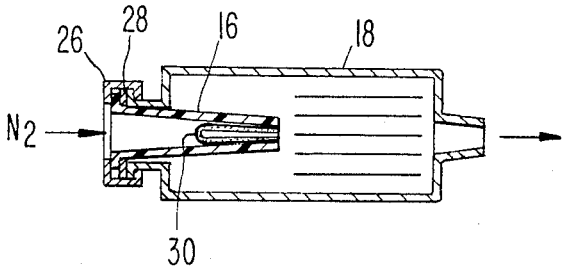
FIG. 2 is a side cross-sectional view of the combined filter/static eliminator cartridge of FIG. 1.

Referring now to FIG. 2, there is shown a side cross-section of the static eliminator/removable filter portion of the blow-off gun. As can be seen, the hollow fiber filter 16 is advantageously attached to the static eliminator 18 by a retainer 26. A seal 28 assures that the gas will not bypass the filter. The hollow fiber filter 16 has a major portion 30 extending within the static eliminator 18. This both achieves a more compact design and creates overall production savings due to the gun's reduced length. Thus, the cylindrical housing 20 preferably is significantly shorter than in prior designs.

It will be appreciated that the amount of filtration area of the hollow fiber filter may be varied to permit a change in the flow rate. Periodic replacement of the filter elements is contemplated, to avoid clogging of the hollow fibers.

Figure 3:
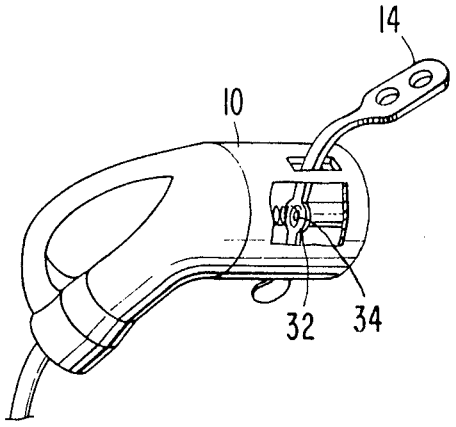
FIG. 3 is a front view of a preferred valve assembly according to the invention.

In order to prevent ambient air from flowing back ionizing and generating ozone and corroding the static eliminator, means are provided in the handle portion for maintaining a small positive flow of gas through the gun. In the preferred embodiment shown in FIG. 3, a shut off valve 32 is disposed in the handle 10 associated with the trigger mechanism. A small pinhole 34 is made in the center of the shut off valve 32, by any method conventional in the art, for example, a laser.

Depending on the gas used in the blow-off gun, the size of the pinhole may be adjusted. For example, if ordinary air is used the flow rate should be made faster by enlarging the pinhole. This will help to prevent oxygen present in the airflow from corroding the static eliminator. Corrosion may be further prevented, for example, by forming a portion of the gun of corrosion resistant materials, such as stainless steel. If an expensive, but oxygen free, gas such as nitrogen is used the flow rate need only be sufficient to prevent backflow of ambient air. Accordingly, the pinhole may be very small.

It should become obvious to one skilled in the art that the present invention is not limited to the preferred embodiment shown and described.

What is claimed is:

1. A device for clean room application comprising:

a static elimination means having a housing with a gas inlet end and a gas outlet end;

a removable compact hollow fiber filter retained in the gas inlet end of said housing; and gas supplying means in communication with the gas inlet end, so that gas passes from said gas supplying means and through said hollow fiber filter and into said static elimination means.

2. The device according to claim 1 wherein a major portion of said hollow fiber filter extends into said static elimination means.

3. The device according to claim 2, further comprising:

a retaining means retaining said hollow fiber filter; and a seal disposed between an inner portion of said hollow fiber filter and the housing of said static elimination means.

4. The device according to claim 1, wherein said static elimination means is a nuclear gas ionizer.

5. The device according to claim 4, wherein the nuclear gas ionizer is a polonium -210 ionizer.

6. The device according to claim 1, further comprising means, disposed between said gas supplying means and said hollow fiber filter, for maintaining a constant positive flow of gas through said hollow fiber filter and static elimination means.

7. The device according to claim 6, wherein said maintaining means comprises a valve seat having a pinhole therein.

8. A device for clean room application comprising:

a static elimination means having a housing with gas inlet end and a gas outlet end;

a removable ultrafilter retained in the gas inlet end of said housing;

said removable ultrafilter having a major portion extending into said static elimination means; and gas supplying means in communication with the gas inlet end of said housing, so that gas passes from said gas supplying means through said ultrafilter and into said static elimination means.

9. The device according to claim 8, further comprising means, disposed between said gas supplying means and said hollow fiber filter, for maintaining a constant positive flow of gas through said hollow fiber filter and static elimination means.

10. The device according to claim 9, wherein said maintaining means comprises a valve seat having a pinhole therein.

* * * * *